US005203939A

United States Patent [19]

Sperling et al.

[11] Patent Number: 5,203,939

[45] Date of Patent: Apr. 20, 1993

[54] PROCESS FOR PRODUCTION OF INTERNALLY BONDED SEWING THREADS

[75] Inventors: Philip E. Sperling, Charlotte, N.C.; Robert M. Gailey, Paisley; Leslie A. Bathie, Glasgow, both of Scotland; A. Edwin Suttle, Marion, N.C.

[73] Assignee: Coats Viyella, PLC, Manchester, England

[21] Appl. No.: 741,053

[22] Filed: Aug. 5, 1991

[51] Int. Cl.[5] ..... D02G 3/40

[52] U.S. Cl. ..... 156/148; 156/161; 156/180; 156/229

[58] Field of Search ..... 156/180, 148, 161, 229; 57/210, 211, 234, 238, 239, 242, 258

[56] References Cited

U.S. PATENT DOCUMENTS

| | | | |
|---|---|---|---|
| 2,313,058 | 3/1943 | Francis, Jr. . | |
| 2,713,242 | 7/1955 | Esler . | |
| 3,388,030 | 6/1968 | Estes et al. | 156/180 X |
| 3,409,493 | 11/1968 | McIntyre et al. | 156/180 |
| 3,460,338 | 8/1969 | Morrison . | |
| 3,492,802 | 2/1970 | Marzocchi et al. . | |
| 3,495,393 | 2/1970 | Wada et al. . | |
| 4,095,403 | 6/1978 | Beraud et al. | 156/148 X |
| 4,299,884 | 11/1981 | Payen | 57/211 X |
| 4,378,725 | 4/1983 | Hospers et al. | 156/180 X |

FOREIGN PATENT DOCUMENTS

| | | |
|---|---|---|
| 0052268 | 10/1981 | European Pat. Off. . |
| 2204119 | 9/1972 | Fed. Rep. of Germany . |
| 2124919 | 9/1972 | France . |
| WO88/09403 | 12/1988 | PCT Int'l Appl. . |
| 951088 | 6/1960 | United Kingdom . |
| 1155850 | 6/1969 | United Kingdom . |
| 1217238 | 12/1970 | United Kingdom . |
| 1380423 | 1/1975 | United Kingdom . |
| 1575817 | 10/1980 | United Kingdom . |

*Primary Examiner*—Jeff H. Aftergut

*Attorney, Agent, or Firm*—Bell, Seltzer, Park & Gibson

[57] ABSTRACT

The invention relates to internally bonded sewing threads and to processes for the production of the internally bonding sewing threads. The internally bonding sewing threads of the invention include three multifilament yarns wrapped helically about a thermoplastic bonding core yarn. Processes of the invention include an improved process for preparing a precursor plied thread which is thereafter thermally treated to provide the internally bonded sewing thread. In addition, the invention provides batch and continuous processes for converting the precursor plied thread into internally bonded sewing thread.

22 Claims, 4 Drawing Sheets

PROCESS FOR PRODUCTION OF INTERNALLY BONDED SEWING THREADS

FIELD OF THE INVENTION

The invention relates to internally bonded sewing threads and to processes for the production of the sewing threads. More particularly, the invention relates to an internally bonded sewing thread prepared by the thermal treatment of a plied thread which includes a low melting point thermoplastic yarn core. The invention also relates to a batch and to a semicontinuous process for producing these sewing threads.

BACKGROUND OF THE INVENTION

Bonded sewing threads are used extensively in the textile industry where high strength stitching is required. Traditionally, bonded sewing threads are made from single or plied, twisted multifilament yarns. The thread is treated with a bonding agent causing the twisted filaments to adhere and create a stable consolidated structure. The bonding material is typically a synthetic polymer applied as an aqueous dispersion or as a solution in an organic solvent. Application of the bonding agent is accomplished by immersion, lick roll treatment, or similar known processes.

The traditional bonded sewing threads as described above involve several drawbacks. The application of the bonding agent is a messy process and causes waste of material and equipment, personnel time and plant time due to cleaning necessities. Qualitatively, the application of the bonding agent can be difficult to control resulting in threads having different sewing properties.

When exteriorly bonded sewing threads are used in high speed sewing operations, another set of difficulties can occur. The threads are passed at high speed back and forth through the narrow eye of a rapidly moving sewing needle. As the bonded and twisted thread moves through the needle, the bonding agent can be stripped from the outside of the plied thread. This stripping can occur simultaneously with an untwisting of the thread as it rapidly is pulled back and forth through the needle eye and the material being sewn. In such situations, the stripped and untwisted thread is apt to separate into its individual plies or filaments leaving individual strands susceptible to plucking and subsequent breaking by the sewing machine hook or looper resulting in a defective product and/or an interruption in the manufacturing process.

Yet another difficulty encountered with exteriorly bonded sewing threads involves the accuracy of the dyeing process. The dye must be applied to the sewing thread prior to the application of the bonding agent; otherwise, the bonding agent would prevent uniform absorption of the dye by the thread. However, the bonding agent application on top of the dyed thread together with the sewing lubricant can cause coloration changes in the thread. These changes can vary from color to color and depending upon the type and amount of bonding agent applied to the thread. Thus, the dyeing, bonding agent, and lubricant application processes must be carefully controlled in unison in order to provide threads of the proper predetermined color and shade.

Internally bonded sewing threads have been proposed in U.S. Pat. No. 2,313,058 to Francis, French Patent Publication No. 2,124,919 and European Patent No. 0052268. As proposed in these patents, a plurality of twisted yarns are plied with a low melting yarn, which itself can be a monofilament or multifilament yarn. The low melting yarn is provided as the core component of the plied structure with the other yarns being helically wrapped around the low melting yarn. Subsequent thermal treatment in a batch process melts the core low melting yarn resulting in bonding of the plied structure.

Although these plied sewing threads having a bonded interior were proposed more than four decades ago in the Francis patent, and nearly two decades ago in the previously mentioned French patent, commercialization of plied, interiorly bonded sewing threads has not previously been accomplished on a substantial scale due, in part, to difficulties involved in the manufacture of these threads. As proposed in the prior patents, the manufacture involves a series of separate, serial batch processes. Various difficulties can be encountered in each of the batch steps resulting in a final product having undesirable properties.

The first step for providing an internally bonded, plied sewing thread is directed to the plying of the plural multifilament yarns around the low melting core yarn. This is accomplished by twisting the winding or exterior yarns in a first direction, for example, in the S direction; combining the twisted yarns with the center yarn; and then twisting the resultant composite in the opposite direction to provide a relatively balanced plied thread. During this processing step it is important to ensure that the low melting yarn is confined to the center of the composite structure. Otherwise, the resultant composite thread is not evenly bonded and cannot be evenly dyed.

The second processing step involves rewinding of the plied and twisted composite thread onto thermal treatment drums. Care must be exercised during the rewinding step in order to apply the proper and uniform tension to the composite thread on the heat treatment drum and in order to ensure that the low melting point center yarn remains in the center of the plied structure. The subsequent thermal treatment step requires careful control of temperature, treatment times and the like in order to ensure that the low melting point center yarn is softened and melted sufficient to bond the outer yarns to each other. On the other hand, excessive temperature during the thermal treatment can discolor the composite thread resulting in a poorly dyed thread product.

A process and apparatus for ensuring positioning of one yarn as the center yarn in a plied structure is disclosed in U.S. Pat. No. 2,713,242 to Esler. According to the disclosure of this patent, the yarn intended for the core yarn is fed together with a plurality of covering yarns to a twisting machine with the core yarn being supplied at a slower rate than the covering yarns. A special apparatus is employed to effect the differential rate feeding of the two yarns. The apparatus involves a pair juxtaposed drive rolls having their axis parallel to each other. One portion of each drive roll is of smaller diameter than the remainder of the drive roll. An idler roller contacts both drive rollers and rides in the valley between the drive rolls. The covering yarns are fed across the larger portion of the drive rolls and around the idler roller. The core yarn is fed around the smaller portion of the drive rolls and also across the idler roller.

Previously mentioned European Patent No. 0052268 discloses a process for producing an internally bonded sewing thread in which a core low melting yarn and a plurality of covering yarns are fed to a twisting apparatus while the core yarn is maintained under greater tension than the covering yarns. The core low melting yarn is later melted following winding onto heating reels. This rewinding operation is conducted under extremely high tension. According to this patent, thermal treatment achieves the best bonding when the thread is at the highest possible tension. Thus, rewinding onto the heat treating drums is carried out at high tensions, e.g., between 600 and 1100 grams.

Despite the substantial commercial interest in internally bonded sewing threads, there has been minimal commercial activity in the sewing thread industry in the actual manufacture of internally bonded sewing threads. Moreover, despite the substantial interest in processes for producing internally bonded sewing threads, no process has been proposed or implemented for continuous or semi-continuous production of internally bonded sewing threads.

SUMMARY OF THE INVENTION

The invention provides improved internally bonded sewing threads and processes for the preparation of the sewing threads. The sewing threads of the invention comprise three multifilament yarns of nylon, polyester or the like which are twisted and internally bonded together. As compared to prior art internally bonded sewing threads, the threads of the invention can have improved strength, improved internal adhesion and a greater uniformity of properties. The invention provides improved processes for the manufacture of the sewing threads including an improved process for the manufacture of the precursor plied thread and improved batch and continuous processes for converting the precursor plied thread into a bonded sewing thread.

In accordance with one aspect of the invention, an improved process is provided for the manufacture of the precursor plied thread. Three multifilament yarns are simultaneously twisted in a first direction and the twisted yarns are directed to a pair of driven, stepped feed rolls which are skewed in relation to each other. At the same time, a low melting point core yarn is directed to the skewed, stepped feed rolls. Each of the skewed, stepped feed rolls include two axially aligned and abutted segments, the first segment having a diameter and peripheral surface greater than that of the second segment. The three twisted multifilament yarns are wrapped a plurality of times about the larger segments of the skewed, driven feed rolls so that the twisted yarns are fed from the feed rolls at a first speed. The low melting point core yarn is wrapped a plurality of times about the smaller diameter segments of the feed rolls so that the core yarn is fed from the feed rolls at a second speed which is less than the first speed.

The three twisted multifilament yarns traveling at the first speed are combined downstream of the feed rolls with the low melting point yarn traveling at the second slower speed and the combined threadline is tensioned and twisted in the direction opposite to the twisting direction of the individual multifilament yarns. Twisting is preferably accomplished by conventional ring twisting apparatus which also winds the plied thread onto a twister bobbin. As a result of this process, the low melting point core yarn is confined to the center of the precursor plied thread and is maintained under a slight tension while the multifilament covering yarns are wrapped helically around the low melting point yarn.

Because the multifilament covering yarns are simultaneously twisted and continuously passed to the stepped skewed feed rolls, the three multifilament yarns are delivered from the feed rolls with substantially identical twist and substantially identical tension and speed. Because the core yarn is delivered by the same feed rolls to the composite yarn twisting step at a slower speed, the core yarn is maintained in the center of the plied, composite precursor thread. The provision of skewed, stepped feed rolls allows the multifilament yarns and the center yarn to be wrapped around the feed rolls a sufficient number of turns so that the feeding rate of the yarns and the core yarn can be controlled precisely and at a precise tension. The continuous process for forming the precursor thread thereby provides for the production of a highly uniform and precisely configured plied composite thread.

According to a another aspect of the invention, the precursor thread is thereafter converted into an internally bonded sewing thread via a series of batch processes or in a continuous process. In the batch process, the precursor plied thread is wound onto a heating drum at a controlled tension of less than about 500 grams, preferably less than about 300 grams depending on the overall thread denier. The controlled tension is sufficient to maintain the core, low melting point yarn under tension and to prevent the composite plied thread from kinking. Advantageously, the tension is at least about 30 grams and preferably, the tension is at least about 100 grams.

The wound drums are treated in a steam autoclave at a temperature above the melting point of the core yarn and for a time sufficient to soften the core yarn throughout the length of the wound plied thread and to provide bonding of the multifilament yarns to the core yarn. In the case of a nylon low melting point core yarn having a melting point of about 110 to 125° C., the composite thread is typically treated for a period of about twenty minutes to one hour and at a temperature of up to about 125–135° C. Thereafter, the bonded thread is rewound onto a wet processing package and wet processed, e.g. dyed, at a temperature greater than the melting point of the core yarn and preferably at a pH above 5.0 to dye the internally bonded thread and to improve the internal bonding thereof.

In the continuous heat treating process of the invention, the steps of rewinding the precursor thread onto heat treating drums, the use of superheated steam, and the rewinding from the heat treating drum to the wet processing, e.g., dyeing, package can be eliminated. In the continuous heat treating process of the invention, the precursor plied thread is continuously passed into a stretch heating zone wherein the thread is stretched and heated while in the stretched condition for a time and at a temperature sufficient to soften the interior low melting point core yarn and bond the exterior multifilament yarns together. Advantageously, the heated composite thread is thereafter further heated while being maintained under a low tension sufficient to allow shrinkage of the bonded thread. The low tension heating step results in further bonding and dimensional stabilization of the thread. Following the heating step or steps, the bonded thread is passed directly to a winding zone where it is wound onto a plastic or metal center to form a package suitable for wet processing, e.g., dyeing. Thereupon, the packages are wet processed, e.g. dyed, preferably at a temperature of greater than the melting point of the low melting core yarn and preferably at a pH of greater than about 5.0.

Advantageously, heating of the plied precursor thread is accomplished using a series of driven draw rolls. The first draw roll is typically unheated and passes the thread to a second draw roll which is heated and driven at a speed greater than the speed of the first draw roll. The thread is wrapped around the heated draw roll a plurality of times so that the thread is maintained in contact with the heated draw roll for a predetermined period of time. Thereafter, the thread is advantageously passed to a third draw roll which is also heated and which is driven at a speed less than the speed of the second draw roll so that the thread is allowed to shrink while it is heated.

The internally bonded sewing threads produced by the batch or continuous processes of the invention are uniform and have substantial adherence between the bonded threads. The bonding material is confined fully to the interior of the bonded thread so that the thread can be dyed to a highly uniform color. The continuous thermal treatment process of the invention eliminates the multiple batch steps required in prior art processes and allows the production of internally bonded sewing threads in an economical and expedient manner.

BRIEF DESCRIPTION OF THE DRAWINGS

In the drawings which form a portion of the original disclosure of the invention.

DETAILED DESCRIPTION OF THE PREFERRED EMBODIMENT

In the following, a detailed description of the preferred embodiment of the invention is given. It will be recognized that although specific terms are used, they are used in a descriptive and not in a limiting sense in that the invention is susceptible to numerous variations and equivalents within the spirit and scope of the description of the invention.

Figure 1:
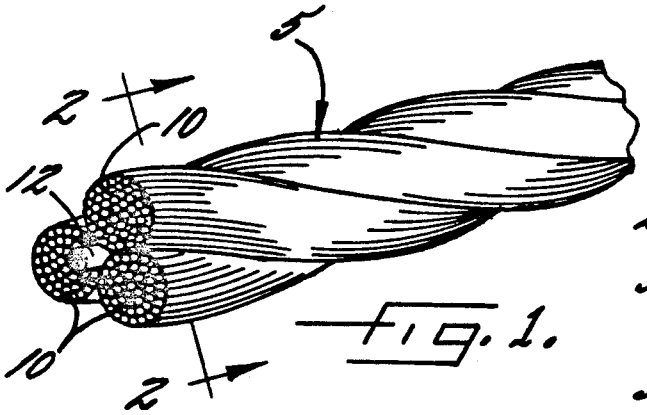
FIG. 1 illustrates a perspective view of a precursor plied thread prepared according to one preferred process embodiment of the invention.

FIG. 1 is an exaggerated illustration of the precursor plied thread 5 used to prepare internally bonded sewing threads. Three identical multifilament yarns 10 are wrapped helically about a lower melting point core yarn 12. The outer multifilament yarns 10 are typically composed of a relatively high tenacity multifilament continuous yarn such as nylon, polyester or the like. By way of illustration, the individual or singles multifilament yarns 10 typically have a denier (decitex) within the range of from about 50 to about 500 denier (56–556 decitex). Thus, the plied precursor thread illustrated in FIG. 1 typically has a total denier (exclusive of the core yarn) ranging from about 150 to about 2,000 denier (167 to about 2,222 decitex).

The low melting point core yarn 12 can be a monofilament or multifilament yarn composed of a low melting point copolymer capable of bonding to the multifilament yarns 10. In the case of exterior multifilament yarns composed of nylon, the core yarn 12 is advantageously a nylon terpolymer derived from three nylon monomers. Preferred nylon terpolymers are disclosed in U.S. Pat. No. 4,225,699 issued Sep. 30, 1980 to Edward Schmid, et al., which is incorporated herein by reference. Preferred nylon terpolymer bonding yarns are commercially available as FLOR-M Type 1020 from UNITIKA, Japan; or as GRILON Fusible bonding yarn from EMS-CHEMIE AG., Switzerland. Preferred nylon bonding yarns have a melting point of less than about 150° C., preferably a melting point in the range of about 110 to about 125° C. When the exterior yarns 10 are polyester yarns, a polyester copolymer or terpolymer bonding yarn can advantageously be employed as the core yarn. Polyester bonding yarns preferably have a melting point of less than 170° C., preferably in the range of about 130° C. to about 165° C.

Figure 2:
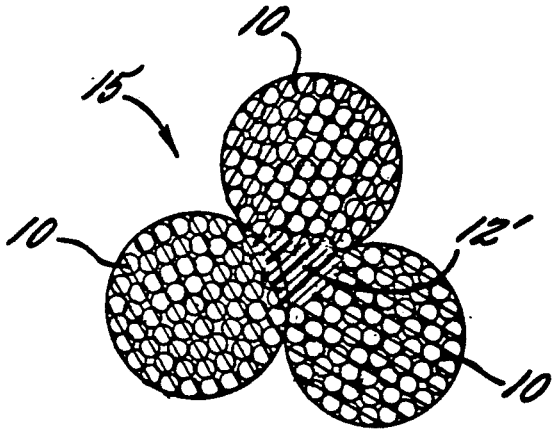
FIG. 2 is a cross sectional illustration of the thread of FIG. 1 following thermal treatment and is taken along line 2—2 of FIG. 1.

FIG. 2 is a greatly exaggerated illustration of the cross-section of the internally bonded thread 15 prepared by heat treating the precursor plied thread 5 of FIG. 1. The low melting point core yarn 12 has been thermally melted and dissipated as thermally fused mass 12' to thereby bond together the multifilament yarns 10. The thermally fused bonding agent 12' is contained fully within the interior of the composite internally bonded thread 15 so that the bonding material 12' does not interfere with subsequent dyeing treatment of the internally bonded thread 15.

Figure 3:
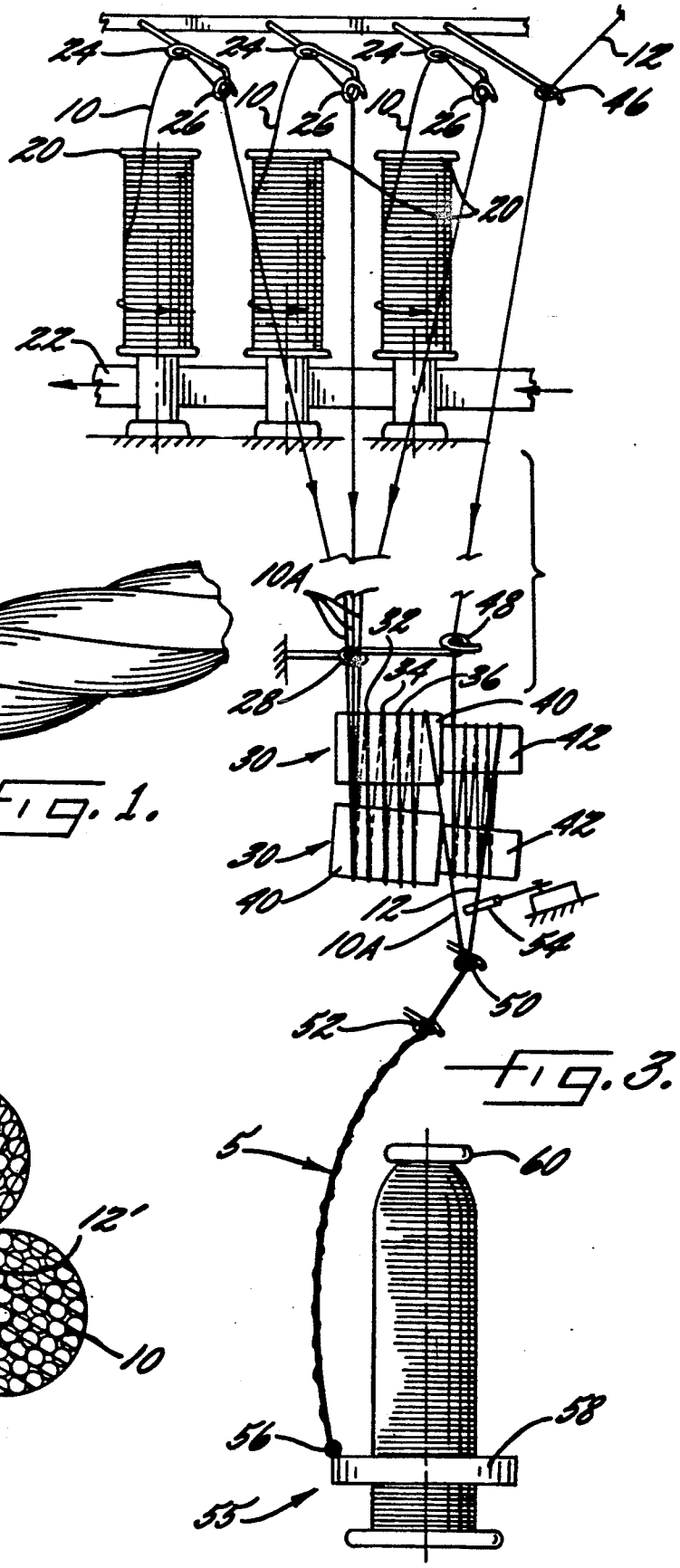
FIG. 3 schematically illustrates a preferred apparatus and method for the manufacture of the precursor plied thread in accordance with the invention.

FIG. 3 illustrates schematically the preferred process for production of the precursor plied thread 5 of FIG. 1. A plurality of packages 20 of the multifilament yarn 10 are simultaneously driven in a first direction by a drive belt 22 to thereby impart identical twist to the three multifilament yarns 10. The individual yarns are directed from the rotating package 20 through guides 24 and then to a guide 26. The rotation of package 20 provides twist in a first direction to the multifilament yarns 10A withdrawn from the guides 26.

The twisted multifilament yarns 10A are gathered at guide 28 and wrapped a plurality of times about a pair of identical driven rolls 30. The two driven rolls 30 are mounted in a skewed, i.e. non-parallel, juxtaposed arrangement in order that successive windings 32, 34, 36 of the twisted yarn 10A about the rolls 30 may separate naturally from one another.

Each roll 30 includes two axially aligned and abutted segments 40 and 42. The left-hand segments 40 have a greater diameter and peripheral surface than the right-hand segments 42. Thus, when each of the rolls 30 is rotated, the peripheral speed of the larger segment 40 is greater than the peripheral speed of the smaller diameter segment 42. Advantageously, the difference in diameter of the two segments is such that the peripheral speed of the smaller segments 42 will be about 10% less than the peripheral speed of the larger segments 40. It will be recognized that the ratio of sizes between the smaller diameter segments 42 and the larger diameter segments 40 can be varied widely depending on the denier of the multifilament yarns 10A. Thus, in general the peripheral speed of the smaller segments 42 of the rolls can range from between about 5 to about 20% less than the peripheral speed of the larger segment 40 of the rolls.

The core yarn 12 is fed in a pretensioned state sufficient to prevent slippage from a second source, not shown, via a pair of guides 46 and 48 to the skewed and stepped drive rolls 30 and is wrapped about the smaller diameter segments 42 of drive rolls 30 a plurality of times.

The number of turns that the twisted multifilament yarns 10A and the core yarn 12 are wrapped around the drive rolls 30 can be varied. Typically, the yarns will be wound at least about 5 turns around the drive rolls to ensure that there is sufficient tension and frictional contact between the yarns and the drive rolls 30 that the twisted yarns and core yarn are delivered from the drive rolls at the precise peripheral speed of the drive rolls.

Because the core yarn 12 is fed by the lower diameter segments 42 of the drive rolls, core yarn 12 is delivered by the drive rolls to a combining guide 50 at a lower speed than twisted yarns 10A. Advantageously, core yarn 12 passes across a conventional break detector 54 prior to combining at guide 50 with the multifilament yarns 10A. Because the core yarn is delivered at a lower speed, the core yarn will be under a greater tension than the multifilament yarns 10A and is thus susceptible to breakage. The break detector 54 sounds an alarm or notification at the machine and individual spindles in the event that the tension on the core yarn 12 causes a break.

The combined yarns are passed through the pigtail guide 50 to another pigtail guide 52 and to a conventional ring twister 55 which includes a revolving guide or traveler 56 which moves on a traversing ring 58. As the plied thread 5 is wound onto a twister bobbin 60, the ring twister imparts twist to the plied thread in the direction opposite to the twist imparted to the multifilament single yarns 10. The normal balloon tension imparted by the ring twister 55 is sufficient to stretch the lower melting point core yarn 12 and to maintain the resultant plied thread 5 in a unkinked condition. As is normal, the twist inserted into the plied thread 5 by rotation of the spindle (not shown) driving the bobbin 60 passes back to pigtail guide 50. The winding angle, which is controlled by the relationship between the bobbin diameter, ring diameter, and the traveler, ensure control of winding tension which is important to proper thread structure during start up. The preferred winding angle should be in excess of 20 degrees.

The amount of twist imparted to the plied thread 5 will be dependent upon the denier of the singles multifilament yarns 10 and upon the denier of the core yarn 12. Typically, the denier of the core yarn 12 is such that the core yarn 12 constitutes between about 2 and about 10 percent by weight, preferably between about 2.5 and about 8 percent by weight, based upon the total combined deniers of the three singles yarns 10. The twists per meter imparted to the composite structure 5 will be sufficient to wrap the singles multifilament yarns 10 tightly about the core yarn 12.

The twists per meter in the plied thread 5 can range from about 650–700 twists per meter for low denier singles multifilament yarns e.g., having individual deniers of 50–70 (56–78 decitex), to about 250–375 twists per meter for high denier singles multifilament yarns, e.g., having individual deniers of 420–480 denier (467–533 decitex). The ratio of twist in the plied thread 5 to the twist in the opposite direction in each of the singles yarns 10 is believed to be significant and typically is in the range of from about 0.65 to about 0.95, more typically from about 0.80 to about 0.85. Thus, a plied thread consisting of three 70 denier yarns wrapped about a 20 denier core yarn can have about 770–810 twists per meter in each of the multifilament 70 denier singles yarns and about 625–665 twists per meter in the plied thread. Similarly, when the multifilament singles yarns each have a denier of about 210, the twist applied to the individual multifilament singles yarns can be about 450–585 twists per meter and the twist applied to the plied thread can be about 380–480 turns per meter. The core yarn used in this plied thread can have a denier preferably of about 20–30.

Figure 4:
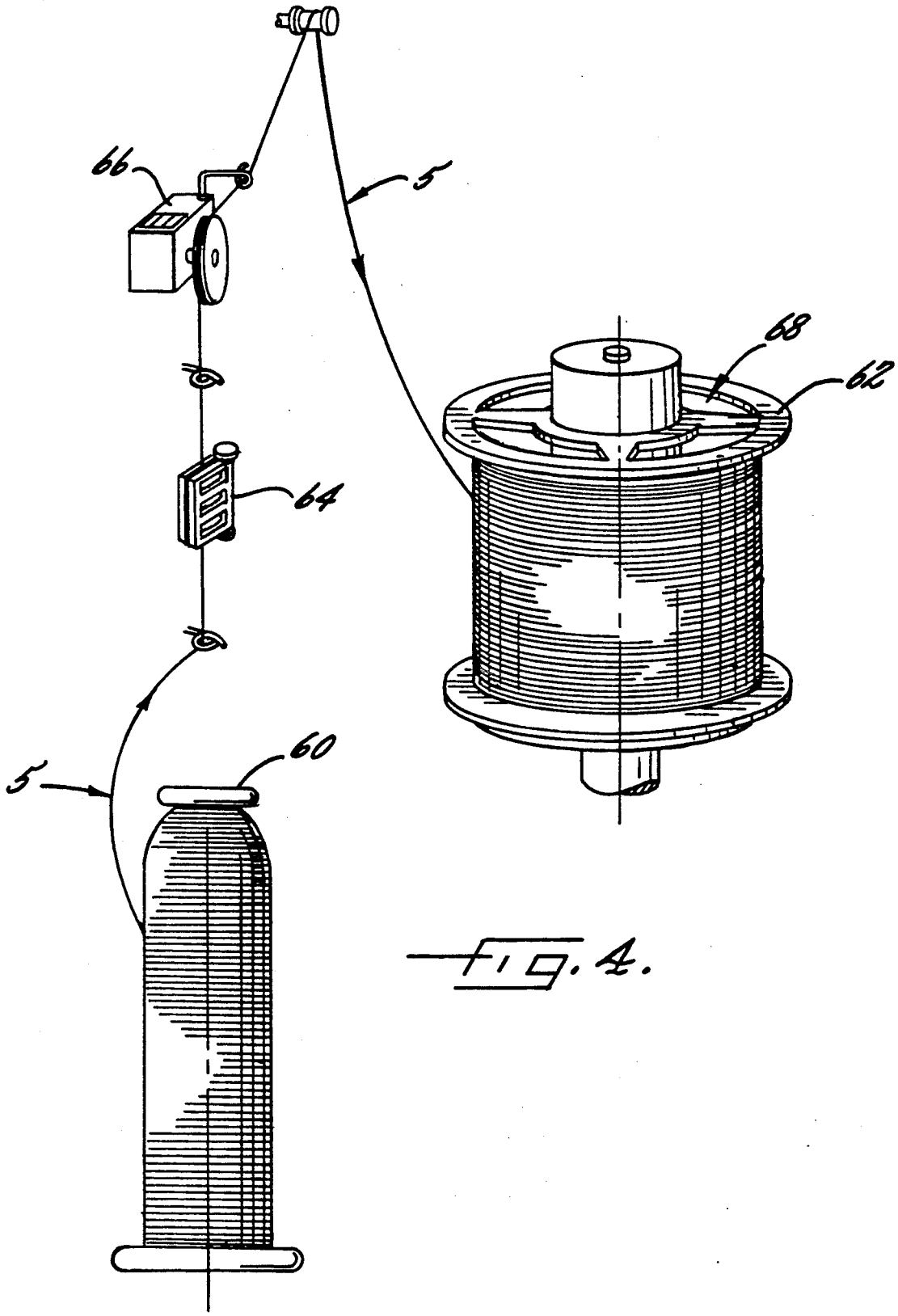
FIG. 4 is a schematic view illustrating the process of rewinding the precursor plied thread onto a heating drum under controlled tension in accordance with another aspect of the invention.

The twister bobbin 60 comprising the plied and twisted precursor thread 5 is thereafter passed to a rewinding operation as illustrated in FIG. 4. The plied thread is wound under a constant tension onto a heating drum 62 which is driven by a drive means (not shown). The thread tension during the rewinding operation is controlled by an adjustable gate tensioning device 64. Gate tensioning devices are known in the art. In this device the thread passes between two sets of intermeshing rods. An adjustable spring loading device changes the tension by changing the angle of the thread around the bars. Other known tensioning devices can be substituted for gate tension 64.

Although the prior art states that tension during winding onto a heating drum should be extremely high, it has been found that excess tension imparts undesirable internal stresses to the thread and can cause the center yarn to migrate to the outside of the thread during melting. Accordingly, the tension during the rewinding operation herein is advantageously maintained below about 500 grams, preferably below about 300 grams, and most preferably below about 200 grams. The amount of tension will depend in part on the total denier of the plied thread 5. For example, a plied thread of three 210 denier (233 decitex) singles yarns is preferably wound onto the heating drum 62 at constant tension of about 100 grams. When the singles in the plied thread have a denier of 420 denier (467 decitex) the rewinding operation is best accomplished at a constant tension of about 150 grams. If there is too little tension, the thread 5 can kink as it is wound onto the drum and/or the bond strength within the thread can be decreased.

The thread is preferably passed across a conventional measuring device 66 during the rewinding operation. It has been found that the subsequent heating step is best accomplished when the amount of thread 5 wound onto heating drum 62 is kept below the amount of thread which would constitute a full bobbin of the twisted thread 60 although this is not considered critical. Advantageously, a single bobbin 60 is used to prepare two heating drums 62. Thus, in the case of 210 denier three ply thread the counting device 66 signals when about 11,000 meters of thread have been wound onto the heating drum 62. At that point, the winding operation is stopped. The drum 62 having plied thread 5 wound thereon is removed and the remainder of the bobbin 60 is wound onto a fresh empty drum 62.

The heating drums as illustrated in FIG. 4 can be of any conventional type. Advantageously, the heating drums should be dynamically balanced and are made of a conductive metal exhibiting low distortion during heating such as hardened, anodized aluminum and are constructed to have a hollow interior section 68 which allows steam and hot gases to enter into the interior of the drum during the heating operation. Drums having a winding surface diameter of about 9 inches have been successfully employed.

Figure 5:
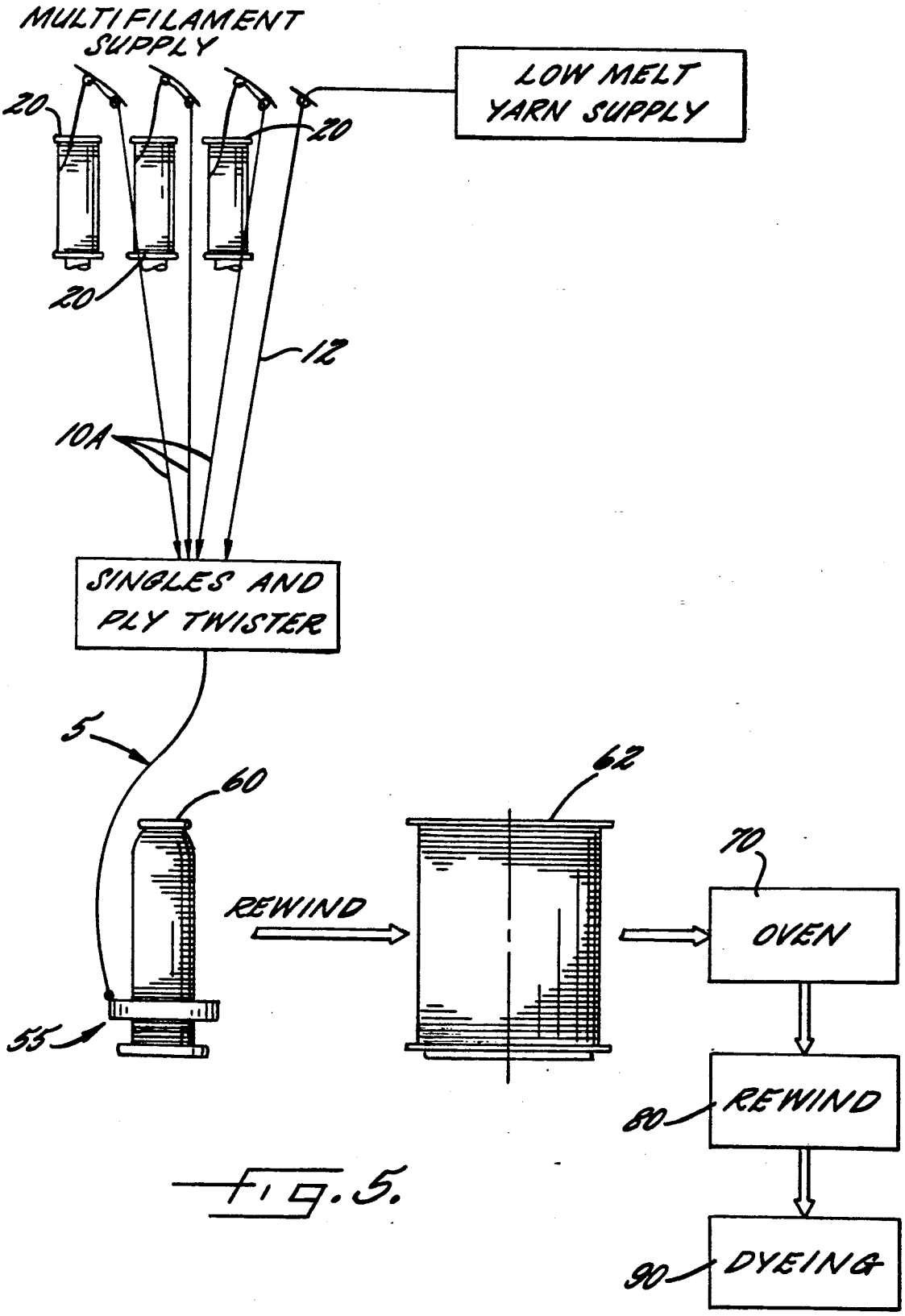
FIG. 5 is a schematic flow diagram illustrating the batch steps for preparing an internally bonded sewing thread in accordance with the invention.

As schematically illustrated in FIG. 5, the next step of the batch process involves treating the precursor plied thread in an autoclave or oven 70. Advantageously, a plurality of wound drums 62 are supported on a single cart and a plurality of such carts are enclosed within a sealed autoclave wherein the drums are heated in a stepped heating process. The stepped heating operation is advantageously conducted using superheated steam and preferably involves heating the threads to a temperature of at least about 125–135° C. (in the case of nylon) for a sufficient period of time that all of the wound thread is brought to and held at this temperature.

One preferred such heating cycle can be accomplished by first heating the thread with super-heated steam at about 105° C. for 6–10 minutes; thereafter increasing the temperature to about 115° C. and holding the temperature for 10–14 minutes; exhausting and replacing the steam several times to ensure that all threads are being penetrated evenly; increasing the temperature to about 130° C. and holding this temperature for 15–25 minutes; repeatedly exhausting and replacing the steam at this temperature several times; thereafter unloading the bonded and set thread.

The set and bonded thread is removed from the autoclave operation and rewound onto wet processing packages and the packages are thereafter wet processed, e.g., dyed, in a closed package dyeing apparatus. In order to ensure the best bonding of the threads, the dyeing or other wet processing operation is modified according to a preferred aspect of the invention by increasing the temperature of the dyeing or other wet processing operation to at least the initial melting point of the low melting point core yarn 12. Typically, dyeing of nylon threads can be conducted at a temperature of 90–100° C. In accordance with this invention, the dyeing is conducted at a temperature of at least about 110° C., preferably between about 115 and 125° C. In addition, the dyeing process is also advantageously modified by controlling the pH of the dye bath so that the pH is maintained above about 5.0.

Following the dyeing or other wet processing operation 90, the thread packages are dried. Advantageously, the packages are dried using an RF heating dryer of a conventional type. It has been found that RF heating improves or preserves the thread properties as compared to other conventional heating methods such as oven drying or centrifuge drying.

Figure 6:
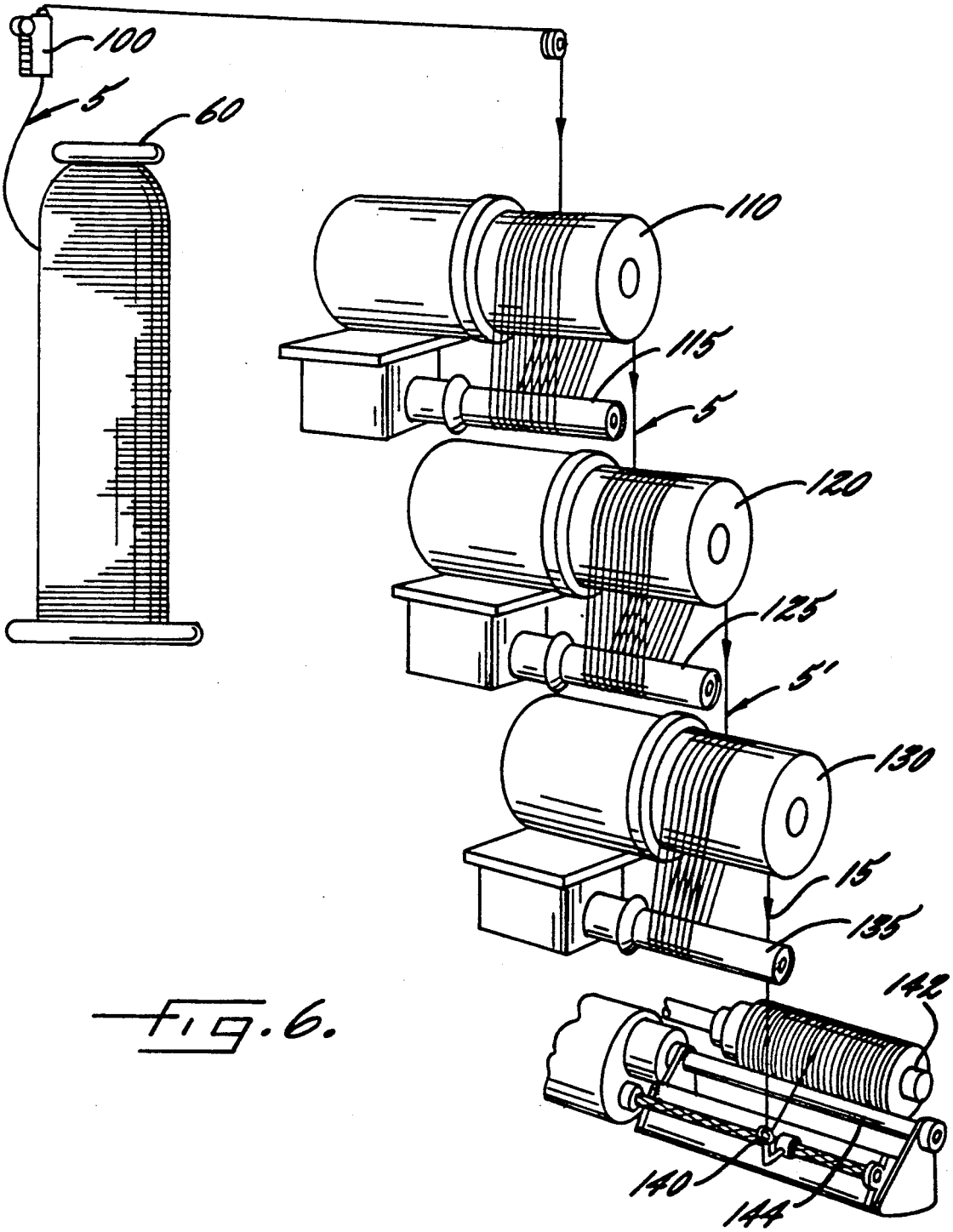
FIG. 6 schematically illustrates a preferred process and apparatus for the continuous thermal treatment of the precursor plied thread to provide an internally bonded sewing thread in accordance with a preferred aspect of the invention.

FIG. 6 illustrates the preferred continuous thermal bonding process of the invention. The precursor plied thread 5 is supplied from the twister bobbin 60 via a tension control 100 to a series of godet draw rolls 110, 120 and 130. Each of the godet draw rolls includes an associated separator roll 115, 125 and 135 which is slightly skewed with respect to its associated godet roll in the conventional manner.

The tension gate 100 is set at a low tension of about 30 to about 100 grams, sufficient to supply the precursor plied thread 5 to the first godet roll 110 in a straight and unkinked state. The first godet roll 110 is advantageously maintained at ambient temperature although heating can be employed if desired. Thread 5 is wrapped a plurality of times about godet roll 110 and separator roll 115. Godet roll 110 is a driven roll having an associated drive means, not shown. The number of wraps around the godet roll 110 and separator roll 115 is sufficient that the thread leaving the godet roll 110 achieves precisely the speed of the godet roll.

The tensioned thread leaving godet roll 110 is passed to the second set of draw rolls comprising godet roll 120 and separator roll 125. Godet roll 120 is driven at a speed in excess of the speed of godet roll 110 so that the thread 5 is stretched between the first and second set of draw rolls. Advantageously, the speed of godet roll 120 is from about 2 to about 20% greater, preferably from about 5 to about 15% greater, most preferably about 10%, greater than the speed of the first godet roll so that the precursor thread 5 is drawn about 10% between the two sets of draw rolls.

Godet roll 120 is a heated roll and is advantageously maintained at a temperature substantially above the melting point of the low melting core yarn 12 in the plied thread 5. In the case of terpolymer nylon core yarn having a melting point in the range of about 110° C. to about 125° C., the godet roll 120 is maintained at a temperature of from about 210° C. to about 230° C., preferably about 215° C. to about 225° C., e.g., 220° C. The thread is wrapped around the heated godet roll 120 and its associated separator roll 125 a sufficient number of turns so that there is a dwell time of the yarn on the rolls 120 and 125 of between about 0.25 to about 2.0 seconds, preferably about 0.5 to about 1.5 seconds. For example, a three ply, 210 denier singles, plied thread can be wrapped about rolls 120 and 125 from 20 to about 30 turns depending on the size and speed of the rolls to achieve a dwell time of greater than 0.5 seconds, preferably from about 0.9 to 1.5 seconds at 220° C.

The heat treated precursor thread 5' is fed from heated godet roll 120 to a second heated godet roll 130 which is advantageously heated to the same temperature as godet roll 120, i.e. about 210–230° C., preferably about 220° C. Godet roll 130 is driven at a speed of 2–10% less, preferably about 4–6% less than the speed of godet roll 120 so that the thread shrinks between godet rolls 120 and 130. The heat treated thread 5' is wrapped a plurality of times about heated godet roll 130 and its associated separator roll 135 to achieve a residence time of typically about one-half the residence time of the thread on roll 120 although this residence time can be increased or decreased if desirable. Thus, the heat treated thread 5' can be wrapped about heated godet roll 130 about 10–20 turns again depending on roll size and speed. The final bonding is achieved on heated godet roll 130 and thus, the thread 15 fed from roll 130 is internally bonded sewing thread.

The internally bonded sewing thread 15 is passed under a tension compensating device (not shown) and then through a traverse guide 140 and wound onto a wet processing package 142 via a drive roll 144 which contacts the face of the thread package in the conventional manner. Dyeing of the thread 15 is preferably accomplished in the manner described previously.

Numerous advantages are achieved by employing the continuous thermal treating process as illustrated in FIG. 6 in place of the batch process illustrated in FIG. 5. Thus, the steps of rewinding the precursor plied thread onto a heating drum; batch treating the drums in an autoclave; and rewinding the heat treated thread onto wet processing packages; are eliminated. In addition, yellowing of the thread which is sometimes effected in the autoclave treatment is substantially eliminated. Moreover, the continuous treating process is more rapid and efficient. Still further, by thermally treating the thread under tension, as on heated draw roll 120, the ultimate elongation at break of the final heat treated thread can be controlled to less than about 25% if desired or required by end use specifications.

Although one or a series of heated draw rolls, as illustrated in FIG. 6, constitute the preferred embodiment of the continuous thermal treating process according to the invention, it will be recognized that other means for thermally treating the precursor thread while stretching the precursor thread can be substituted for the arrangement illustrated in FIG. 6. Thus, the thread can be treated in a steam heated tube between differentially driven draw rolls, which are not heated; or heated pins as are conventionally used in industrial yarn manufacturing processes could also be employed.

The invention has been described in considerable detail with reference to its preferred embodiments. However, variations and modifications can be made without departure from the spirit and scope of the invention as described in the foregoing detailed specification and defined in the appended claims.

That which is claimed is:

1. A process for the preparation of internally bonded sewing thread comprising:

providing a plied thread having three multifilament yarns wrapped helically about a low melting point core yarn;

winding said plied thread onto a heating drum at a uniform tension in the range of between about 50 and about 500 grams;

heating said drum comprising said wound plied thread in a closed autoclave with superheated steam at a temperature above the melting point of said core yarn and for a time sufficient to soften said core yarn throughout the length of the plied thread wound on said drum to thereby provide said internally bonded sewing thread; and thereafter wet processing said internally bonded sewing thread at a temperature above the melting point of said low melting point core yarn.

2. The process of claim 1 wherein said three multifilament yarns are continuous nylon multifilament yarns and wherein said low melting point core yarn is a nylon copolymer or terpolymer monofilament or multifilament yarn.

3. The process of claim 2 wherein said heating step is conducted at a temperature of between about 110° C. and 135° C.

4. The process of claim 2 wherein said wet processing step is conducted at a temperature greater than about 110° C.

5. The process of claim 4 where the three multifilament yarns each have a denier in the range of between about 50 and about 480 and wherein the low melting point yarn has a denier of from about 2 to about 8 percent of the total combined denier of the three multifilament yarns.

6. The process of claim 4 wherein said wet processing step is conducted at a pH of greater than about 5.0.

7. The process of claim 1 wherein said multifilament yarns are continuous polyester multifilament yarns and wherein said core yarn is polyester copolymer or terpolymer monofilament or multifilament yarn.

8. The process of claim 1 wherein the uniform tension during said winding step is maintained within the range of from about 100 to about 200 grams.

9. A continuous thermal treating process for the preparation of an internally bonded sewing thread comprising:

providing a plied thread having three multifilament yarns wrapped helically about a low melting point core yarn;

passing said plied thread continuously through a stretch heating zone wherein said plied thread is stretched and heated while in said stretched condition to a temperature sufficient to soften said low melting point core yarn, bond the exterior multifilament yarns together and confine the low melting point yarn to the interior of the bonded thread; and continuously withdrawing internally bonded plied thread from said stretch heating zone.

10. The process of claim 9 wherein said thread is stretched in an amount of at least 2 percent during passage through said stretch heating zone.

11. The process of claim 10 additionally comprising the step of continuously passing the internally bonded plied thread withdrawn from the stretch heating zone through a second heating zone wherein said internally bonded plied thread is heated while maintained under a tension sufficient to allow shrinkage of said internally bonded plied thread to thereby improve the bonding of said bonded plied thread and to improve the dimensional stability thereof.

12. The process of claim 11 wherein said internally bonded thread is continuously withdrawn from said second heating zone and directed to a winding zone wherein said thread is wound continuously onto a wet processing package.

13. The process of claim 12 wherein said internally bonded plied thread wound onto said wet processing package is thereafter wet processed in a package dyeing apparatus at a temperature of greater than about 110° C.

14. The process of claim 13 wherein said three multifilament yarns are continuous multifilament nylon yarns.

15. The process of claim 10 wherein said internally bonded plied thread is thereafter wet processed at a temperature above the melting point of said core yarn.

16. The process of claim 10 wherein said three multifilament yarns are continuous polyester multifilament yarns.

17. A continuous thermal treatment process for the preparation of an internally bonded sewing thread comprising:

providing a plied thread having three multifilament yarns wrapped helically about a low melting point core yarn;

continuously passing said plied thread to a first draw roll rotating at a first predetermined peripheral speed and wrapping said plied thread a plurality of turns about said first draw roll;

directing said plied thread from said first draw roll at said first predetermined speed to a second draw roll driven at a second predetermined peripheral speed which is at least 2% greater than said first predetermined peripheral speed, said second draw roll being heated to a temperature greater than the melting temperature of said low melting point core yarn, and wrapping said plied thread a plurality of turns about said second draw roll whereby said plied thread is heated sufficiently to soften said low melting point core yarn;

directing said plied thread from said second draw roll at said second predetermined speed to a third draw roll rotating at a third predetermined peripheral speed which is less than said second predetermined peripheral speed, said third draw roll being heated to a temperature above the melting point of said low melting point core yarn and wrapping said plied thread a plurality of turns about said third draw roll; and continuously withdrawing said plied thread from said third draw roll at said third predetermined speed and winding said plied thread onto a wet processing package.

18. The process of claim 17 wherein said second draw roll is heated to a temperature of at least 200° C.

19. The process of claim 18 wherein said third draw roll is heated to a temperature of at least 200° C.

20. The process of claim 19 wherein said three multifilament yarns are continuous nylon multifilament yarns.

21. The process of claim 19 wherein said three multifilament yarns are continuous polyester multifilament yarns.

22. The process of claim 19 wherein said thread wound onto to said wet processing package is thereafter wet processed in a package dyeing apparatus at a temperature above the melting point of said low melting point core yarn.

* * * * *